United States Patent [19]

Lindstrom

[11] 4,438,925

[45] Mar. 27, 1984

[54] HANDLE FOR RACQUETBALL RACQUET

[76] Inventor: James A. Lindstrom, 1595 Trollhagen Dr., Fridley, Minn. 55421

[21] Appl. No.: 347,102

[22] Filed: Feb. 9, 1982

[51] Int. Cl.[3] ..... A63B 49/08

[52] U.S. Cl. ..... 273/75; 273/73 J; D21/222

[58] Field of Search ..... 273/73 J, 75, 81 R, 273/67 R, 76; D21/211, 212, 213, 222

[56] References Cited

U.S. PATENT DOCUMENTS

| | | | |
|---|---|---|---|
| D. 192,740 | 5/1962 | Ziabicki | 273/76 X |
| 1,690,312 | 11/1928 | Rosan | 273/165 |
| 2,141,519 | 12/1938 | Cunningham et al. | 273/81.4 |
| 2,298,505 | 10/1942 | Ottman | 273/81.4 |
| 2,481,778 | 9/1949 | Pearson | 273/165 |
| 2,876,010 | 3/1959 | Hugman | 273/81.2 |
| 3,173,689 | 3/1965 | Serblin | 273/81 R |
| 3,868,110 | 2/1975 | Jones | 273/75 |
| 4,183,528 | 1/1980 | An | 273/75 |
| 4,213,609 | 7/1980 | Swanson | 273/75 |

*Primary Examiner*—Richard C. Pinkham
*Assistant Examiner*—Matthew L. Schneider
*Attorney, Agent, or Firm*—Merchant, Gould, Smith, Edell, Welter & Schmidt

[57] ABSTRACT

A handle (22) for a racquetball racquet (20) is disclosed. The handle (22) includes an elongated member having front (52), intermediate (60), and rear (50) portions. The front portion (52) defines a handle outer surface of greater circumferential extent than the rear portion (50). The front portion (52) is adapted for being engaged about a portion thereof by the two front fingers (56*a, b*) of a player's hand while the rear portion (50) is adapted for being gripped by the two back fingers (54*a, b*) of a player's hand, whereby the front (52) and rear (50) portions provide for a handle (22) which allows for a relatively hard grip by the back two fingers (54*a, b*) and a less hard grip by the two front fingers (56*a, b*) thereby allowing the wrist to relax and remain flexible so as to reduce arm stiffness and improve a player's game.

10 Claims, 8 Drawing Figures

HANDLE FOR RACQUETBALL RACQUET

TECHNICAL FIELD

The present invention relates to racquetball racquets. More particularly, the present invention relates to a racquetball racquet handle.

BACKGROUND OF THE INVENTION

During the past few years, the sport of racquetball has enjoyed a phenominal rise in popularity as indicated by the number of people who partake of the sport and the number of facilities being built to accommodate the players. Many racquetball texts and instructional classes are available to instruct a person in the rules and skills of playing the game of racquetball.

To play the game of racquetball, a person needs a racquet, a ball and a court to play on. There are a number of different brands of racquetballs to choose from with varying degrees of liveliness and playing life. In addition, there are numerous brands of racquets available which are made from a variety of materials such as wood, aluminum, fiberglass, etc. Although much effort has been expended in utilizing new materials for racquets, thera has been little attention devoted to the construction of the racquet handle.

The racquetball racquet is held by one hand when playing or making a shot. Unlike tennis where the wrist is held fairly stiff during a swing, a racquetball swing requires quick wrist action. It is therefore generally recognized that the wrist must be flexible as the racquet is moved through a swing to allow for a quick flexing or snapping action at the wrist. With the racquets currently existing on the market, a player has a tendency to grip the handle too tightly so that the wrist is not sufficiently flexible. This creates two problems, one of which may result in considarable arm soreness and the other of which may result in the lack of proper control and the subsequent failure to impart sufficient velocity to the racquet during the racquet swing. Consequently, it is a frequent occurrence for those first starting to play the game of racquetball and even those who have considerable racquetball experience to develop a stiff or sore arm after playing several games. Additionally, beginner players often find it frustrating not to have the racquet control which is necessary for an accurate racquetball shot.

The overly tight grip is a result of the general configuration of current racquetball racquet handles. Such handles have the same general circumference or girth along the length of the handle. As a result, all the fingers of the player's hand may tightly grip the handle which causes the wrist and various arm muscles to tighten up. The resultant tightness of the player's wrist and arm contributes to the stiffness or soreness in one's playing arm and furthermore, to the improper control of the racquet during the swing. In addition, current handles somewhat deter quick and accurate movement of the racquet to a position where it can strike an approaching racquet ball. Because of the relatively short back swing the wrist is very important for imparting velocity to the racket during a racquet serving.

The sport of golf has seen many modifications made to the handle of golf clubs, as evidenced by the patents to Serblin U.S. Pat. No. 3,173,689, Rosan U.S. Pat. No. 1,690,312 and Hugman U.S. Pat. No. 2,376,010, in an effort to assure proper grip of a golf club. However, the nature of a golf swing is very unlike that of a racquetball swing. In a golf swing, the handle is held by two hands with the hand nearest the club head being the power hand which imparts most of the velocity to the club head. The above identified patents disclose golf club handles or attachments therefore which tend to reduce over-control of the club swing by the right hand and yet provide for sufficient power during the swing. Due to the substantial differences between a golf club swing and a racquetball racquet swing, the grip required is very dissimilar. Structural features utilized in a golf club handle which assure a more proper grip are not applicable to a racquetball racquet handle because of the great differences in the grip required. In addition to the differences in the swing, the differences in grip are also partially due to the relatively long shaft of a golf club and the construction thereof which enables a whipping or flexing action during the swing. There is no flexing of a racquetball racquet handle and therefore the wrist plays a major role in imparting sufficient velocity to the racquet. It is therefore not obvious to one skilled in tha racquetball art to apply the features disclosed in golf club handles to racquetball racquet handles.

Furthermore, the present invention includes features not obvious in view of the prior art which overcome the above identified problems and other problems associated with the prior art.

SUMMARY OF THE INVENTION

The present invention relates to a handle for a racquetball racquet which includes an elongated member having first and second elongated portions. The first elongated portion is removed from the head portion of the racquet and is adapted for being gripped about a portion thereof by the two back fingers of a player's hand. The second elongated portion is connected to the head of the racquet and defines a handle surface of greater circumferential extent than the first elongated portion. The second elongated portion is adapted for being gripped by the two front fingers of a racquetball player's hand, whereby the handle of the present invention provides for a relatively hard grip by the two back fingers and a less hard grip by the two front fingers of a player's hand thereby allowing the wrist to relax and be flexible so as to reduce arm stiffness, maximize control and improve one's game.

In one embodiment of the present invention, the second elongated portion includes a removable portion. The removable portion is releasably attached to an inner shaft portion of existing handles so as to provide a handle portion having an enlarged girth or circumference. In yet another embodiment of the present invention, the second enlarged portion is provided with indentations for positioning the two front fingers of a player's hand.

The present invention is particularly advantageous because, when a player grips the racquetball handle of the present invention with his hand, the front two fingers are on the enlarged handle section or a portion thereof and the back two fingers on the regular sized handle section or a portion thereof. The front two fingers on the enlarged handle portion are not able to grasp the handle tightly due to the relatively larger girth or circumference of the enlarged portion. The inability of the front two fingers to reach very far about the periphery of the handle prevents the user from gripping the handle too tightly and yet allows the front fingers to be present on the racquet handle for control. The grip is shifted to the back two fingers. This shifting of the finger grip tends to relax the wrist so that the wrist is more flexible thereby eliminating arm soreness and improving one's game because of better wrist control. Thus, the handle of the present invention conforms to the natural physiological characteristics of the human hand better than existing prior art handles.

These and various other advantages and features of novelty which characterize the invention are pointed out with particularity in the claims annexed hereto and forming a part hereof. However for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

DETAILED DESCRIPTION OF THE INVENTION

Figure 1:
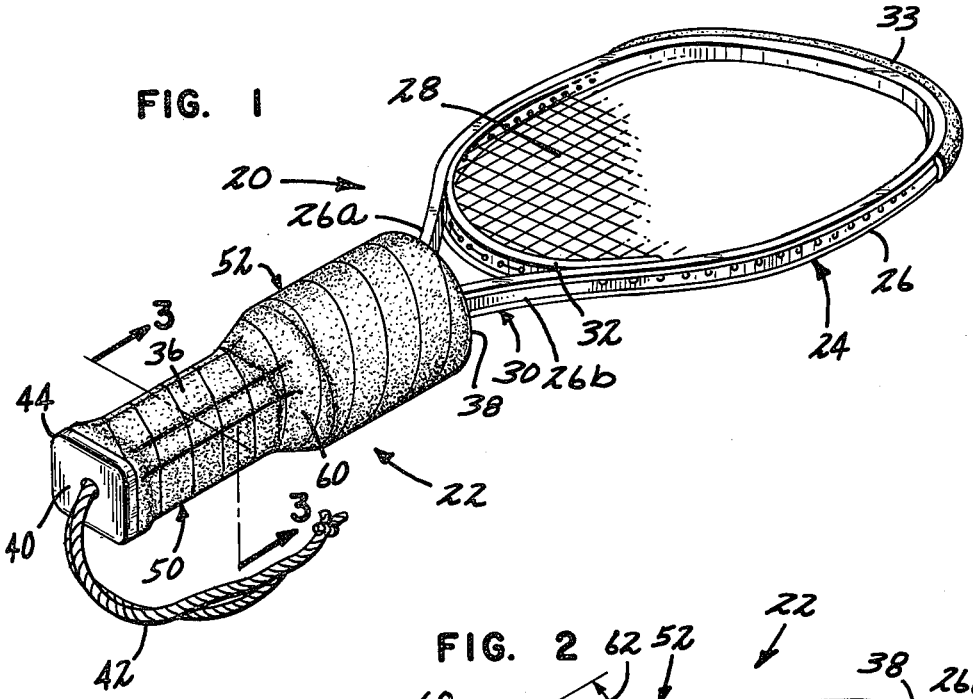
FIG. 1 is a view in perspective of a racquetball racquet having a handle embodying the features of the present invention.

Referring now to the drawings and in particular to FIG. 1 thereof, there is illustrated a racquetball racquet 20 including a handle embodying features of the present invention, the handle being generally identified by reference numberal 22. Racquetball racquet 20 is shown as including a head portion 24. Head portion 24 has relatively thin strands of material such as nylon, gut, etc. strung across a framework 26 so as to form a resilient web portion 28 with which a player attempts to engage or hit a racquetball. Framework 26 is usually a unitary elongated member bent or curved so as to form a generally round or oval head portion 24. Framework 26 may be made of any suitable material such as wood, aluminum, fiberglass etc. The ends of the elongated member of framework 26 are suitably attached to handle 22 so as to form a throat portion 30 which interconnects head portion 24 with handle 22. Typically, throat portion 30 includes a brace 32 positioned between frame portions 26*a*, 26*b* to provide structural support and additional framework for attachment of web portion 28. Frequently, a strip of material 33 is placed about a portion of the racquet head framework to prevent marking and chipping of wall surfaces when making contact therewith.

Figure 3:
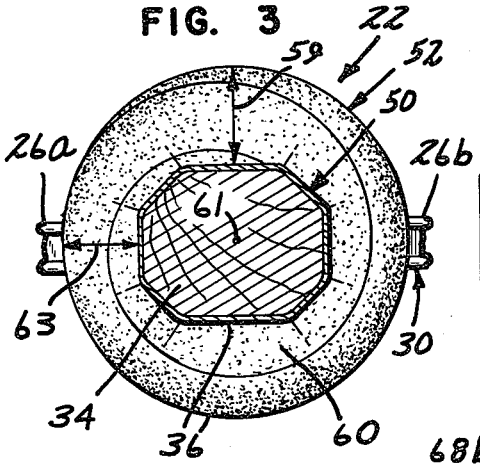
FIG. 3 is a sectional view as generally seen along lines 3—3 of FIG. 1.

In the embodiment shown in FIG. 3, handle 22 comprises a main, unitary inner core or shaft member 34 which is wrapped with a material such as leather to provide a suitable outer layer 36 for gripping by the fingers of a player's hand. Core member 34 may be either solid or hollow and is frequently made from such materials as plastic, aluminum, wood, etc. Although core member 34 is typically made from a unitary mold or a single piece of material, it is possible for core member 34 to include layers of material suitably bound to each other. As shown in FIGS. 1 and 3, core member 34 of the present invention typically has a generally octagonal cross-sectional configuration along a rear portion thereof and a smooth cylindrical configuration along a front portion thereof. Additionally, core or shaft member 34 may ba molded or formed so that its external surface has a non-smooth construction.

A forward end 38 of handle 22 is suitably attached to head portion 24 of racquet 20 while a back end 40 of handle 22 is attached to a cord-like member which forms a loop portion 42. A player will typically place his or her hand through loop portion 42 and generally twist the racquet a few times before gripping handle 22. Thus, if the player loses his or her grip of the handle, the racquet will not leave the immediate vicinity of the player's wrist due to loop 42 which will retain the racquet on the player's wrist.

As shown in FIG. 1, back end 40 generally includes end piece 44 which is fastened at the end of handle 22 generally for aesthetic reasons and to cover any sharp edges that might be present at the end of the handle. In addition, end piece 44 does somewhat assist in preventing the handle from slipping out of a player's hand in that there is typically a slight enlargment of handle 22 circumference near end 40 due to end piece 44.

Figure 2:
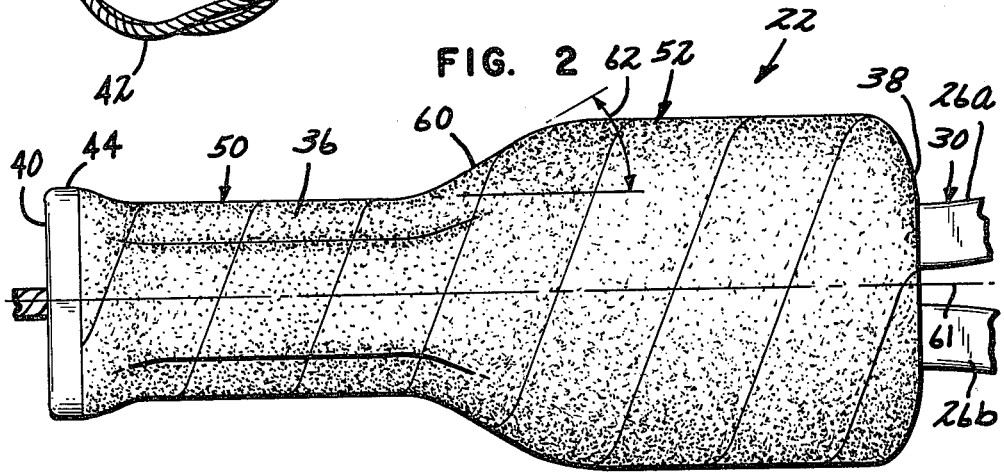
FIG. 2 is a fragmentory side elevational view of a handle of the present invention.
Figure 8:
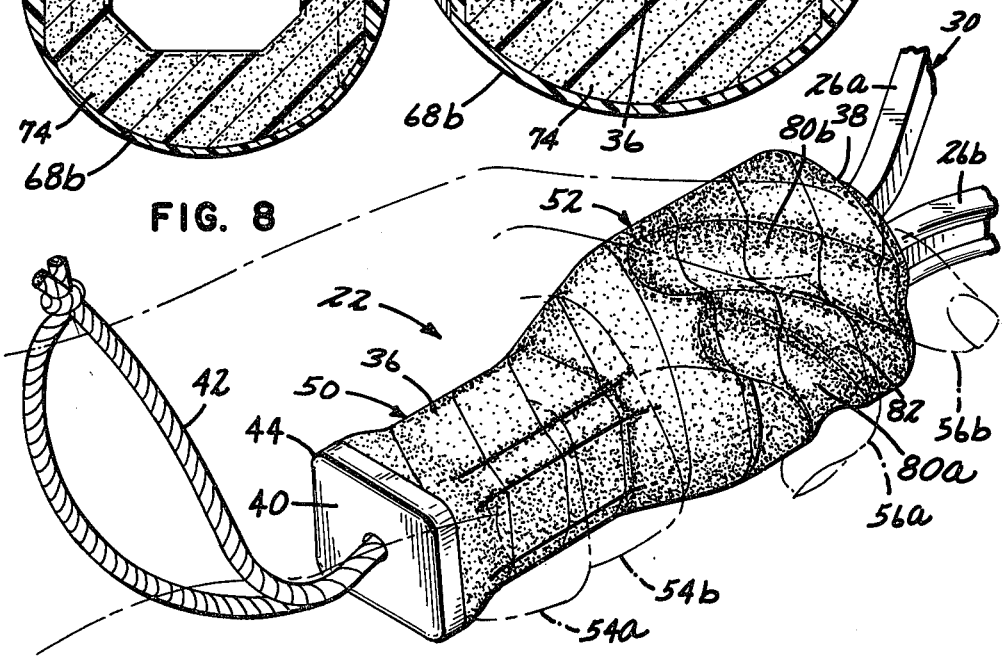
FIG. 8 is a view in perspective of a modified racquetball racquet having a handle of the present invention grasped by a human hand.

As illustrated in FIG. 8, handle 22, embodying the principles of the present invention, is gripped by one hand of a playar such that all four fingers and the thumb make contact with the handle surface. For this purpose, handle 22 includes a first finger gripping section 50 adjacent back end 40 and a second finger gripping section 52 adjacent forward end 38. As shown in FIG. 2, section 52 has a generally larger circumference or girth than section 50 so as to provide an increased finger contacting surface. Typically, section 50 or a portion thereof is engaged by the two back fingers (little and ring fingers) 54*a*, *b* of a player's hand as shown in FIG. 8 and section 52 or a portion thereof is engaged by the two front fingers (middle and index fingers) 56*a*, *b* and the thumb not shown, but positioned generally diametrically opposite fingers 56*a*, *b* on handle 22.

Referring now more specifically to the features of handle 22 of the present invention, there is shown in FIG. 3 a cross-sectional view of handle 22. Enlarged section 52 of handle 22 in the embodiment shown is integral with portion 50, being made from the same unitary core member 34 and being wrapped with an outer layer 36 of leather or the like.

In other embodiments, it is possible to construct enlarged section 52 by wrapping additional layers of material about the circumference of handle 22 along the longitudinal extent of section 52 so as to build up and enlarge the circumference or surface area of handle 22 at section 52.

Section 50 is connected to section 52 of handle 22 by a tapered or divergent section 60 which defines a relatively smooth continuous handle surface between finger gripping sections 50 and 52 such that there are no jagged edges or the like. In a preferred embodiment, section 60 will preferably divert outwardly from the outer surface of section 50 toward the outer surface of section 52 at an angle 62 of approximately 30 to 60 degrees. Furthermore, in a preferred embodiment, the slope or degree of slant of the outer surface of section 60 will remain somewhat constant throughout its longitudinal extent. Consequently, section 60 has a generally conical configuration or shape. If the rate of incline is too great, a jagged or steep edge will be present while an insufficient enlargement of handle 22 at section 52 will result if the incline is not steep enough.

The relative longitudinal dimensions of section 50 and section 52 are preferably such that section 50 is less than the length of section 52 and the divergent section 60 combined. The overall length of handle 22 of the present invention is generally the same as those of racquetball racquet handles currently in use. Section 50 should have sufficient length or longitudial dimension to provide surface area for the two back fingers of a player to grip or grasp the surface of section 50 or a portion thereof. Similarly, section 52 should have sufficient length to provide surface area for the two front fingers and thumb of a player's hand. The exact longitudinal dimensions will vary depending on an individual player's hand size.

In a preferred embodiment, as illustrated in FIG. 3, section 52 will have an outer surface which is one-half to five-eighths of an inch further removed from a longitudial axis 61 of section 50 then the outer surface of section 50 is removed from axis 61 as generally indicated by 59 and 63. However, once again the exact girth or circumference of each section will vary depending on the individual and their hand size.

As shown in the sectional view of the preferred embodiment in FIG. 3, shaft 34 is shown as having an octagonal cross-sectional configuration, along section 50 and as having a generally circular cross-sectional configuration along section 52. However, other cross-sectional configurations may be utilized with the handle of the present invention. Additionally, in the preferred embodiment, sections 52 and 60 are shown as being radially symmetrical about longitudinal axis 61 of handle 22 while section 50 is symmetrical on either side of a vertical or a horizontal plane which extends through axis 61. In addition the outer surface of section 52 is generally parallel to longitudial axis 61 such that section 52 has a generally cylindrical shape while section 60 has a generally conical shape. In alternate embodiments, handle section 52 may be divergent or tapered near front-end 38.

As illustrated in FIG. 2, longitudial axis 61 is the same for the front, intermediate, and rear portions (52, 60, 50) of handle 22. However, in alternate embodiments, the longitudial axes of each handle portion need not be coincident.

Figure 6:
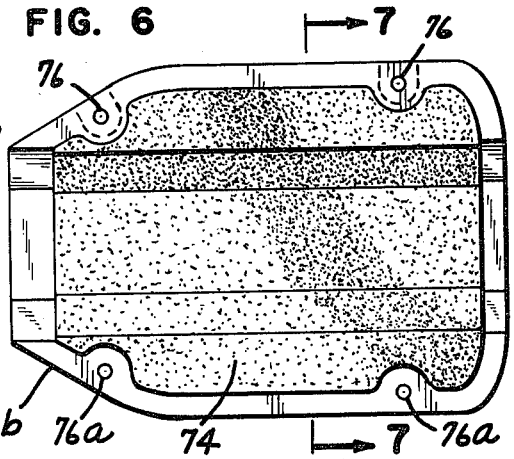
FIG. 6 is a plan view as generally seen along lines 6—6 of FIG. 5 with the racquet handle removed.
Figure 4:
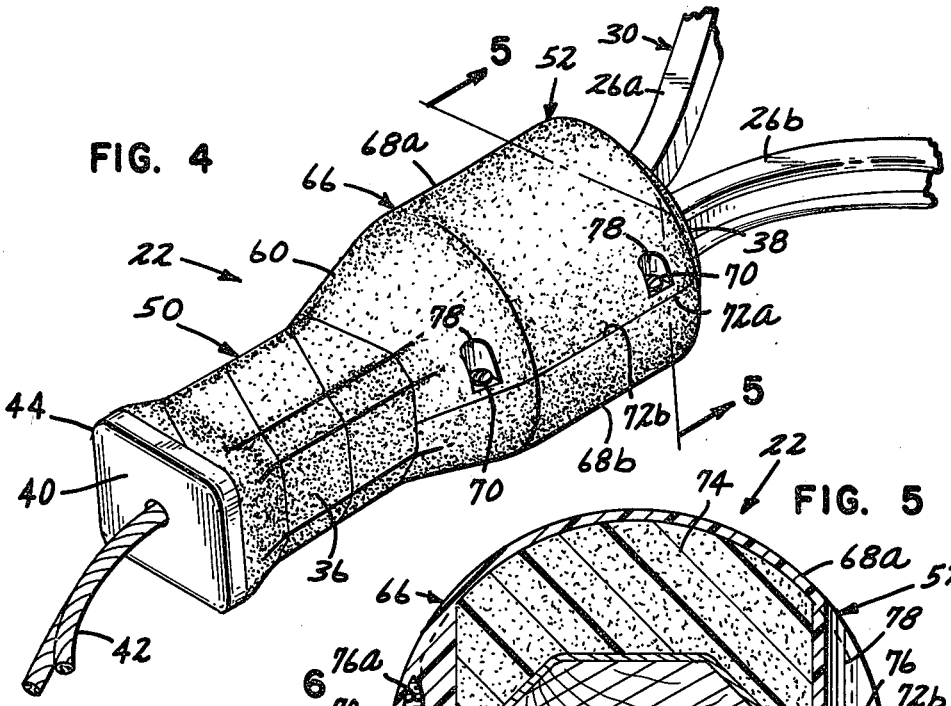
FIG. 4 is a fragmentary view in perspective of a modified racquetball racquet handle with a releasable handle attachment of the present invention.
Figure 5:
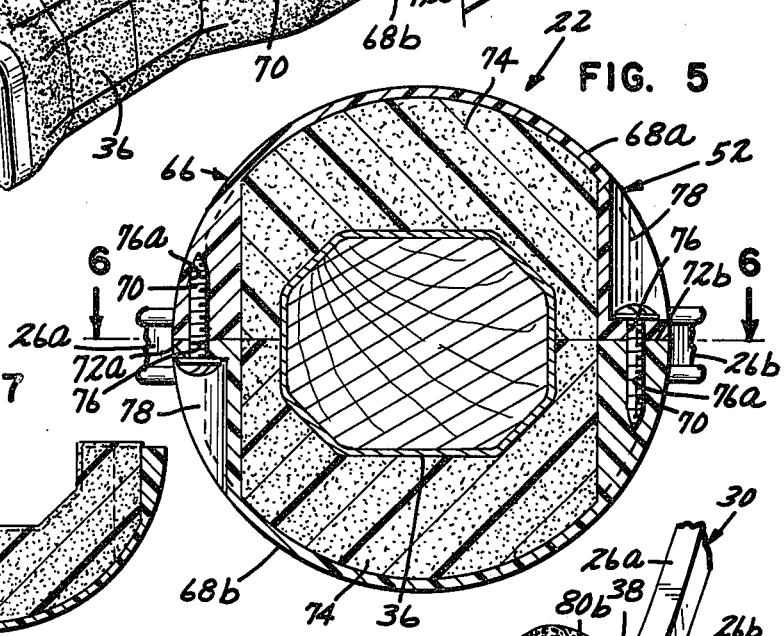
FIG. 5 is a sectional view as generally seen along lines 5—5 of FIG. 4.

A further embodiment of the present invention is illustrated in FIG. 4 wherein a releasable attachment 66 is shown attached to a handle. Attachment 66 includes two matching semi-cylindrical portions 68*a, b* which are adapted for being releasably attached to one another about the circumference of handle 22 so as to form enlarged portion 52. Portions 68*a, b* might be pieces of molded plastic or the like with a ronghened exterior surface or might be wrapped by an outer layer of material such as leather. As illustrated in FIGS. 5 and 6, portions 68*a, b* define apertures 76 extending from the surface thereof through to the surface of the apposing sides 72*a, b* of each semi-cylindrical member 68*a, b*. The apertures of each member 68*a, b* are configured and arranged such that they are aligned with the cooperating apertures 76*a* of the other member 68 whereby a screw-like member 70 may be removably inserted therein to retain members 68*a, b* about the circumference of handle 22. Members 68*a, b* are further shown as defining indentations 78 in the surface thereof where apertures 76 are located such that members 70 do not extend above the surface of members 68*a, b* and interfere with a player's grip.

Figure 7:
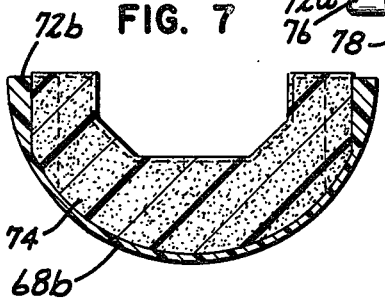
FIG. 7 is a sectional view as seen generally along lines 7—7 of FIG. 6.

As illustrated in FIG. 7, members 68 may include a soft compressible layer of material 74 such as styrofoam on the inside thereof which engages handle 22 and is subsequently compressed by the tightening of screw like members 70. A player may thus readily and easily install attachment 62 on an existing racquet so as to form a handle having an enlarged portion 52.

Illustrated in FIG. 8 is an embodiment of the present invention wherein enlarged section 52 has an uneven surface. In particular, two front finger indentations 80*a, b* are shown as existing on the exterior surface of section 52. The indentations 80 are separated along a portion thereof by a ridge or smoothly contoured protuberance 82. The protuberance 82 separates indentations 80*a, b* and assists in maintaining the proper positioning of the two front fingers. Note that the specific configuration of the indentations 80 may depend on the size of a player's hand and what is a comfortable fit.

In use, irrespective of the specific dimensions or cross-sectional shape, a handle embodying the features of the present invention is held by the playing hand of a player such that front finger 56*b* and preferably the front two fingers 56*a, b* of the playing hand engage enlarged section 52 or a portion thereof and back fingers 54*a, b* engage regular sized section 50 or a portion thereof. Because of the larger cross-sectional configuration or circumference of enlargement 52, front fingers 56*a, b* are held away from the longitudial axis 61 of the handle and do not encircle or wrap around as much of the perimeter of handle 22 as do back fingers 54*a, b*. Consequently, front fingers 56 are not able to grip or grasp handle 22 as tightly as back fingers 54*a, b* grip section 50 which is of lesser cross-sectional configuration or girth than section 52. Thus, handle 22 is largely gripped or held by back fingers 54*a, b* while front fingers 56*a, b* and thumb 58 firmly rest against section 50 so as to provide coordination or control of the racquet swing.

As a result of the above described finger gripping action, the wrist of the playing hand is more flexible thereby allowing for quicker wrist action and more control of the racquet swing or movement. Additionally, because the front fingers do not grip the racket handle as tightly, the wrist and various arm muscles of the playing arm are not as tight or tense and consequently the arm does not have as great a tendency to become stiff or sore after frequent playing.

It should be understood from the foregoing, that even though the above mentioned characteristics and advantages of the handle of the present invention have been set forth, together with details of the structure and function of the invention, the disclosure is illustrative only, and changes may be made in details, especially in matters of shape, size and arrangement of parts, within the principle of the invention, to the full extent indicated by the broad general meaning of the terms in which the appended claims are expressed.

What is claimed is:

1. A handle for a racquetball racquet, comprising:

an elongatad member having a longitudinal axis and including front, intermediate, and rear portions, said front portion having a larger cross sectional configuration in at least two orthogonal directions than said rear portion, said intermediate portion extending from said front portion to said rear portion, said rear portion having a length which is less than said intermediate and front portions combined; said handle providing for a modified grip wherein said front portion or a portion thereof makes contact with the front two fingers of a player's hand and said rear portion or a portion thereof makes contact with the back two fingers of a player's hand, such that said front two fingers cannot extend as far about the periphery of said handle as said back fingers, and are necessarily positioned farther away from said longitudinal axis than said back fingers thereby allowing said back fingers to grip the handle more tightly than said front fingers.

2. A racquetball racquet handle in accordance with claim 1 wherein said front portion is provided with indentations for positioning said two front fingers.

3. A racquetball racquet handle in accordance with claim 2 wherein each of said finger indentations are separated by a contoured protuberance.

4. A handle for a racquetball racquet in accordance with claim 1, wherein said forward, intermediate and rear portions have cross-sectional configurations being generally symmetrical on either side of a vertical plane bisecting said longitudinal axis of said elongated member.

5. A handle for a racquetball racquet in accordance with claim 1, wherein said outer surfaces of said front and rear portions are substantially parallel to said longitudinal axis.

6. A handle for a racquetball racquet in accordance with claim 1, wherein said intermediate portion has a generally conical shape.

7. A handle for a racquetball racquet in accordance with claim 1, wherein said outer surface of said front portion is inclined downwards at both ends of said forward portion.

8. A handle for a racquetball racquet in accordance with claim 1, wherein said front and intermediate portions are radially symmetrical about said longitudinal axis.

9. A gripping attachment for a racquetball racquet handle comprising: a finger gripping structure constructed and arranged for at least partially encircling the circumference of said handle; said gripping attachment being removably attachable to said handle so as to form an elongated member having a longitudinal axis and including front, intermediate and rear portions; said front portion having a larger cross sectional configuration in at laast two orthogonal directions than said rear portion; said intermediate portion extending from said front portion to said rear portion; said rear portion having a length which is less than said intermediate and forward portions combined; said handle providing for a modified grip wherein said front portion or a portion thereof makes contact with the front two fingers of a player's hand and said rear portion or a portion thereof makes contact with the back two fingers of a player's hand, such that said front two fingers cannot extend as far about the periphery of said handle as said back fingers, and are necessarily positioned farther away from said longitudinal axis than said back fingers thereby allowing said back fingers to grip the handle more tightly than said front fingers.

10. A method of gripping a racquetball racquet handle, comprising the steps of:

(a) positioning the back two fingers at least partially about the circumference of a first longitudinal portion of the handle; and (b) positioning the front two fingers at least partially about the circumference of a second longitudinal portion of the handle, said second portion having a larger cross section than said first portion whereby the larger cross section of said second portion prevents the front two fingers from gripping the handle as tightly as the back two fingers.

* * * * *

UNITED STATES PATENT AND TRADEMARK OFFICE

CERTIFICATE OF CORRECTION

PATENT NO. : 4,438,925

DATED : March 27, 1984

INVENTOR(S) : James A. Lindstrom

It is certified that error appears in the above-identified patent and that said Letters Patent is hereby corrected as shown below:

In the title, after "Racquet" insert --And Method of Gripping Same--.

Column 1, line 25, "thera" should be --there--.

Column 1, line 37, "considarable" should be --considerable--.

Column 1, line 67, "golf" should be --golf--.

Column 1, line 68, "golf" should be --golf--.

Column 2, line 21, "tha" should be --the--.

Column 3, line 27, "fragmentory" should be --fragmentary--.

Column 3, line 51, "numberal" should be --numeral--.

Column 4, line 18, "ba" should be --be--.

Column 4, line 40, "playar" should be --player--.

Column 5, lines 21, 31-32, 49, 54 and 57, "longitudial" should be --longitudinal--.

UNITED STATES PATENT AND TRADEMARK OFFICE

CERTIFICATE OF CORRECTION

PATENT NO. : 4,438,925

DATED : March 27, 1984

INVENTOR(S) : James A. Lindstrom

It is certified that error appears in the above-identified patent and that said Letters Patent is hereby corrected as shown below:

Column 5, line 66, "ronghened" should be --roughened--.

Column 6, line 41, "longitudial" should be --longitudinal--.

Column 7, line 5, "elongatad" should be --elongated--.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*